United States Patent [19]

Hoshino

[11] Patent Number: 4,458,574

[45] Date of Patent: Jul. 10, 1984

[54] CYMBAL SUPPORT FOR HIGH-HAT CYMBALS

[75] Inventor: Yoshihiro Hoshino, Nagoya, Japan

[73] Assignee: Hoshino Gakki Company Limited, Japan

[21] Appl. No.: 444,479

[22] Filed: Nov. 24, 1982

[30] Foreign Application Priority Data

Nov. 30, 1981 [JP] Japan ..... 56-192564

[51] Int. Cl.[3] ..... G10G 5/00

[52] U.S. Cl. ..... 84/422 R

[58] Field of Search ..... 84/421, 422

[56] References Cited

U.S. PATENT DOCUMENTS

| | | | |
|---|---|---|---|
| 4,037,509 | 7/1977 | Slomovits | 84/422 H |
| 4,111,095 | 9/1978 | Simons | 84/422 H |
| 4,381,690 | 5/1983 | Kimble | 84/422 H |

FOREIGN PATENT DOCUMENTS

| | | | |
|---|---|---|---|
| 126731 | 1/1946 | Australia | 84/422 H |
| 119622 | 9/1947 | Sweden | 84/422 H |

*Primary Examiner*—Lawrence R. Franklin

*Attorney, Agent, or Firm*—Ostrolenk, Faber, Gerb & Soffen

[57] ABSTRACT

The disclosure concerns a support and stop for the upper cymbal of a high-hat cymbal. The upper cymbal is supported on a longitudinally movable supporting rod. There is a bolt with an upper holding nut threadedly secured above it and a lower holding nut threadedly secured beneath it. The upper and lower holding nuts have respective upper and lower terminal openings passing through them which have internal diameters approximating the diameter of the supporting rod and being smaller than the internal diameter of the bolt. A clamping screw passes through the upper holding nut, pressing the supporting rod against the internal walls of the upper and lower terminal openings, canting the rod in the terminal openings for locking the supporting rod to the support. The cymbal passes through a felt ring which is secured to the exterior of the bolt by the lower holding nut below and by a locking nut above, which locking nut is beneath the upper holding nut.

14 Claims, 4 Drawing Figures

CYMBAL SUPPORT FOR HIGH-HAT CYMBALS

BACKGROUND OF THE INVENTION

The invention concerns the support or stop for one of the pair of cymbals of a high-hat cymbal.

A high-hat cymbal has a pair of cymbals, including a bottom cymbal, which is usually supported stationary on a cymbal stand, and a top cymbal, supported on a support rod and movable to strike against the stationary bottom cymbal. The support rod which moves the cymbal is connected with a foot pedal that is operated by the performer. The support for the movable cymbal is required to hold the cymbal to the longitudinally movable cymbal operating rod. At the rod, the cymbal passes through a felt ring, and the felt ring wraps around a hollow bolt which defines the main body of the support or stop. A longitudinal hole through the bolt receives the cymbal support rod through it, and a clamping screw passes through the side of the bolt to press the rod securely against the surrounding wall of the hole through the bolt. Both above and below the felt ring on the hollow bolt, locking nuts are provided, which secure the felt ring in place and lock the cymbal supported in the felt ring to the bolt, and through the bolt, lock the bolt to the clamping screw and through the clamping screw to the longitudinally movable cymbal support rod, whereby there is a secure connection between the cymbal and its longitudinally movable support rod.

As the foot pedal is operated to move the longitudinally movable rod up and down, the upper cymbal, supported on the rod repeatedly strikes the lower cymbal, supported on a stand. The support for the upper, movable cymbal on the rod receives the impact load each time the cymbals strike one another. Also, there is continued vibration of the cymbal after each striking sound, and the vibration continues for a comparatively long period of time after the initial striking sound is made. This tends to loosen both the holding nut at the bottom of the bolt and the clamping screw clamping the support rod in the bolt. As a result, the supported cymbal may become loosened, and in any event it may shake, and its position along the rod may shift during the course of the performance. One solution to this problem has been providing the holding nut at the bottom of the bolt with an incomplete thread, so that is bites securely into the threaded bolt and loosening of the nut is thereby prevented. However, after long use, shaking of this nut still develops, and the result has not been satisfactory.

SUMMARY OF THE INVENTION

Accordingly, it is the primary object of the present invention to securely clap a movable cymbal of a high-hat cymbal to the longitudinally movable supporting rod therefor and to retain the securely clamped condition of the cymbal through prolonged use during a performance.

It is another object of the invention to provide securement for the cymbal so that the lower holding nut on the bolt which connects the cymbal with the supporting rod will not loosen and so that the clamping screw will not loosen its secure engagement with the supporting rod.

According to the invention, the central bolt which receives the cymbal supporting rod through it has an opening of larger internal diameter than the external diameter of the supporting rod. At the top of the bolt, there is a head, which may be in the form of an upper holding nut secured at the top of the bolt. That nut has an upper terminal opening through it at its upper end with an internal diameter which closely approximates the diameter of the supporting rod, which passes through it. Beneath the upper holding nut and above the felt ring through which the cymbal passes, a locking nut arrangement is provided, as previously. Below the felt ring, a lower holding nut is secured at the bottom of the bolt. The lower holding nut has a lower terminal opening at its bottom end and this opening has an internal diameter also approximating the diameter of the supporting rod which passes through it. Both of the upper and lower holding nuts are screw threadedly engaged on the exterior of the tube, at its ends. The clamping screw for clamping the supporting rod preferably passes through the upper holding nut, just beneath the upper terminal opening for the supporting rod. When the clamping screw is tightened, the supporting rod is bent or canted slightly which respect to the upper terminal opening in the upper holding nut through which it passes, whereby the material of that holding nut "bites" into the supporting rod and securely locks the upper holding nut to the supporting rod, aiding in clamping the cymbal to the supporting rod and preventing movement therealong.

DESCRIPTION OF A PRIOR ART EMBODIMENT

Figure 1:
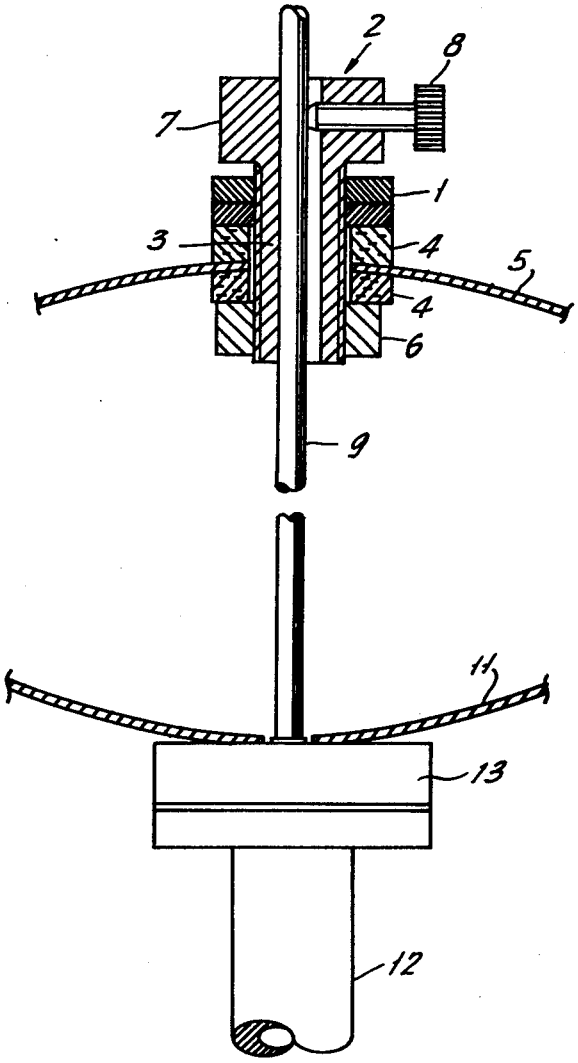
FIG. 1 PRIOR ART
FIG. 1 is a cross-sectional view through the cymbals of a high-hat cymbal showing the manner of mounting the upper cymbal to its pedal-operated supporting rod according to the prior art.

FIG. 1 shows one prior art embodiment over which the invention is an improvement. A fragment of the upper cymbal 5 is shown. It is to be supported by the support and cymbal stop upon the longitudinally movable cymbal supporting rod 9, which is movable longitudinally up and down by a pedal (not shown). The cymbal 5 passes across an annular felt ring 4, which is both above and below the cymbal 5 along the shank 3 of the bolt 2. The main support for the cymbal comprises the hollow bolt 2, with an opening through it, which is slightly wider in its internal diameter than the support rod 9. The bolt 2 must be clamped to the suppport rod 9. The exterior of the shank 3 of the bolt 2 beneath the head 7 is threaded for receiving below described holding and locking nuts. First, the double holding or locking nut 1 is threaded onto the bolt 2 and is locked in position. Then the felt ring 4 with the installed cymbal 5 are fitted over the bolt. Next, the internally threaded lower holding nut 6 is tightened on the exterior of the bottom of the bolt 2. The nuts 1 and 6 lock and position the felt ring 4 and cymbal 5 along the shank 3 of the bolt 2. Through a radially-extending threaded opening in the head 7 of the bolt 2, a clamping screw 8 is tightened into the passage through the bolt 2 and it secures the supporting rod 9 against the interior wall of the opening through the bolt 2. This locks the bolt 2 to the supporting rod 9 and positions the cymbal 5 along the supporting rod.

There is a lower cymbal 11, of which only a fragment is shown. The lower cymbal is supported on the cymbal receiving stand 13 and this stand 13 is supported stationary on a hollow rod 12 which is carried on a lower stand (not shown). The supporting rod 9 for the cymbal passes through the hollow of the rod 12.

As the foot pedal (not shown) is operated, it moves the supporting rod 9 up and down, banging the upper cymbal 5 against the lower cymbal 11. As noted above, the effect of the impact of the two cymbals together and the vibrations of the cymbal 5 eventally loosen the lower holding nut 6 and the clamping screw 8, which may lead to shaking of the upper cymbal 5 and undesired shifting of its height along the supporting rod 9 during the course of a performance.

One proposed solution to this problem is to make the lower holding nut of a synthetic resin material, with an incompletely screw threaded interior for being secured on the thread of the shank 3 of the bolt. This should prevent loosening of the lower holding nut 6. Unfortunately, after long use, the lower holding nut begins to shake and this has not been a satisfactory solution to the problem. No satisfactory solution has been developed to the loosening of the clamping screw 8.

DESCRIPTION OF A PREFERRED EMBODIMENT OF THE INVENTION

Figure 2:
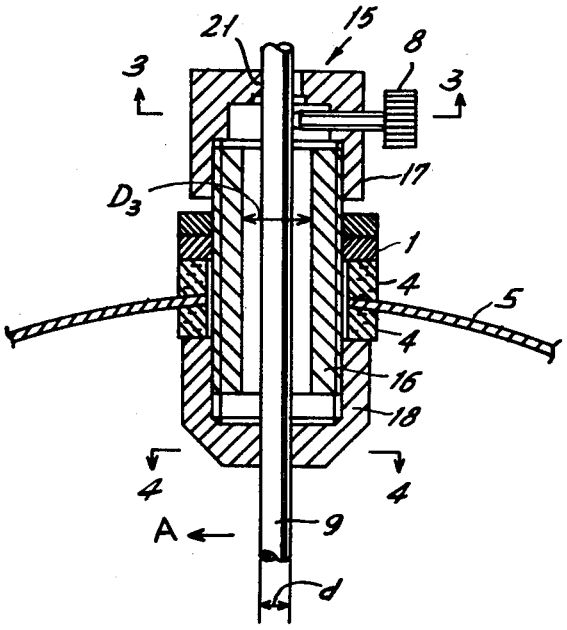
FIG. 2 is a cross-sectional view showing the upper cymbal mounted to the supporting rod according to the invention.
Figure 3:
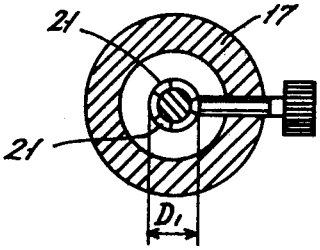
FIG. 3 is a cross-sectional view along the line and in the direction of arrows III in FIG. 2.
Figure 4:
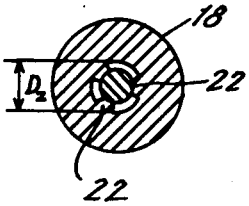
FIG. 4 is a cross-sectional view along the line and in the direction of arrows IV—IV in FIG. 2.

Referring to FIGS. 2–4, the main body of the support or stop for the cymbal 5 comprises a hollow cnetral bolt 16 with a large diameter passageway through it, larger than the diameter of the supporting rod 9 that connects the cymbal 5 with the pedal (not shown).

At the top of the bolt 16, there is a screw-on upper holding nut 17, which is internally threaded at its bottom annular skirt portion for being screwed onto the externally threaded bolt 16. The nut 17 has a narrowed top portion, with a narrowed cross-section upper terminal opening of a diameter $D_1$ through it substantially of the diameter of the supporting rod 9, which freely passes through the upper terminal opening. The unit 17 serves in place of the head 7 of the bolt 2 of the above-described prior art embodiment.

There is the above-noted holding, locking nut 1 on the threaded exterior of the bolt 16 beneath the upper holding nut 17. The felt ring 4 and cymbal 5 are positioned around the bolt 16 beneath the locking nut 1.

At the bottom of the bolt 16 is secured the lower holding or locking nut 18, which replaces the nut 6 in the prior art embodiment. The lower holding nut 18, like the upper holding nut 17, is hollow and is internally threaded at the upper skirt to be screwed onto the threads on the exterior of the bolt 16. The bottom portion of the nut 18 is narrowed and defines a narrow cross-section, lower terminal opening, having an internal diameter $D_2$ approximating that of the supporting rod 9. The supporting rod 9 passes through that lower terminal opening in the bottom of the lower holding nut 18. In particular, the diameters $D_1$ and $D_2$ of the upper and the lower terminal openings are both smaller than the inner diameter $D_3$ of the intermediate bolt 16 of the support. The upper and lower terminal openings are capable of passing the rod 9 because they are of slightly greater diameter than the diameter d of the supporting rod 9.

As can be seen in FIGS. 3 and 4, the interior surfaces of the upper and lower terminal openings through both the upper and lower nuts 17 and 18 are provided with inward, longitudinally extending projections 21 and 22, for providing sharpened, smaller area contact points between the cymbal supporting rod 9 and the upper and lower nuts 17 and 18 for locking the rod 9 to these nuts securely.

As in the prior art embodiment, the clamping screw 8 extends through a radially extended threaded opening in the upper holding nut 17, in the same position as the screw has in the head 7 of the bolt 2 in the prior art embodiment, for securely clamping the supporting rod 9 against the interior walls of both terminal openings.

For assembly of the support shown in FIG. 2, after the felt ring 4 and cymbal 5 are installed on the bolt 6 and the nuts 1 are installed, the rod 9 is passed through the openings through the upper nut 17, the bolt 16 and the lower nut 18, and the clamping screw 8 is tightened for tightening the rod 9 against the interior walls of the upper and lower terminal openings in the upper and lower holding nuts 17 and 18, thereby fixing the cymbal 5 at the desired height along the supporting rod 9.

Tightening of the clamping screw 8 against the rod 9 tends to tilt or cant the rod 9 in the direction indicated by the arrow A, with the upper terminal opening of the upper nut 17 serving as the fulcrum of the rod 9. Because of this attempted tilting of the rod 9, the lower holding nut 18 is biased to be inclined as compared to its axial center, and this causes the screw threaded connection between the lower nut and the bolt 18 to be inclined, causing the cooperating screw threads to bite into each other and securing the nut 18 to the bolt 16. Actually, the edge portions of the upper and lower terminal openings in the upper and lower nuts 17 and 18, respectively, bite into the supporting rod 9, providing additional clamping connection between the nuts and the supporting rod 9, in addition to the clamping screw 8. This prevents the possibility of the nut 18 loosening from the bolt 16 under the impact of use of the cymbal and the vibration following striking of the cymbals. The longitudinally extending, projecting stripes 21 and 22 increase the gripping effect upon the supporting rod. All of these features tend to make it more difficult to loosen both the lower holding nut 18 and the clamping screw 8, and this reduces the chance of the cymbal 5 vibrating and of its becoming loosened enough to shift along the supporting rod 9.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A support and stop for a cymbal of a high-hat cymbal comprising a supporting rod for moving the cymbal and to which the cymbal is to be supported;

a hollow first supporting element having a first internal diameter, in the hollow thereof, which is greater than the second external diameter of the supporting rod, and the supporting rod passing through the hollow of the first supporting element; the cymbal being secured on the exterior of the first supporting element;

a lower holding element secured to the first supporting element, beneath the cymbal, for holding the cymbal against moving off the bottom of the first supporting element; the lower holding element having a lower terminal opening through it, through which the supporting rod passes, and the lower terminal opening having an internal diameter which is smaller than the first internal diameter of the opening in the first supporting element;

a head portion secured at the top of the first supporting element above the cymbal; the head portion having an upper terminal opening through it, through which the supporting rod passes, and the upper terminal opening having an internal diameter which is smaller than the first internal diameter of the opening in the first supporting element;

rod clamping means located in the cymbal support between the upper and lower terminal openings for urging the rod to engage the side walls which define the upper and lower terminal openings, and for urging the rod to cant in the openings.

2. The support and stop for a cymbal of claim 1, wherein the first support element comprises a hollow bolt which is externally threaded; and the lower holding element comprises a lower holding nut, which is internally threaded for being screwed onto the threaded exterior of the hollow bolt.

3. The support and stop for a cymbal of claim 2, wherein the clamping means passes through the head portion and avoids contacting the bolt.

4. The support and stop for a cymbal of claim 2, wherein the supporting rod clamping means comprises a clamping screw placed for being tightened against the side of the support rod, for applying pressure to tilt the rod in the openings.

5. The support and stop for a cymbal of claim 2, wherein the head portion comprises an upper holding nut, with an internally threaded opening therein which is threadedly secured over the external thread of the hollow bolt.

6. The support and stop for a cymbal of claim 5, wherein the clamping means passes through the upper holding nut and avoids contacting the bolt therein.

7. The support and stop for a cymbal of claim 5, wherein the supporting rod clamping means comprises a clamping screw placed for being tightened against the side of the supporting rod, for applying pressure to tilt the rod in the openings.

8. The support and stop for a cymbal of claim 7, wherein the clamping screw passes through the upper holding nut and avoids contacting the bolt therein.

9. The support and stop for a cymbal of claim 7, further comprising the upper holding nut and the lower holding nut being shaped so that the upper and lower terminal openings have projections defined in them for securely engaging the periphery of the support rod.

10. The support and stop for a cymbal of claim 5, further comprising a felt ring on the bolt located between the upper and lower holding nuts, and the cymbal passing through the felt ring for being supported thereon.

11. The support and stop for a cymbal of claim 10, further comprising locking means above the felt ring and below the upper holding nut for holding the felt ring between the locking means and the lower holding nut.

12. A support and stop for a cymbal of a high-hat cymbal, comprising a supporting rod for moving the cymbal, to which the cymbal is to be supported;

a hollow bolt having an opening therein of a first internal diameter, which internal diameter is greater than the second diameter of the supporting rod, and the rod passing through the hollow of the bolt; the cymbal being secured on the exterior of the bolt; the exterior of the bolt being screw threaded;

a lower holding nut having an opening therein which is screw threaded and the lower holding nut being screw threadedly attached on the exterior of the externally threaded bolt, the lower holding nut being secured beneath the cymbal, for holding the cymbal against moving off the bottom of the bolt; the lower holding nut having a lower terminal opening through it, through which the support rod passes, and the lower terminal opening being smaller in diameter than the first diameter of the opening through the bolt;

an upper holding nut having a respective threaded opening therethrough, for being screw threadedly engaged with the exterior of the bolt toward the top of the bolt and above the cymbal; the upper holding nut having an upper terminal opening through it, through which the supporting rod passes, and the upper terminal opening being smaller in diameter than the first diameter of the opening through the bolt;

a support rod clamping screw passing through the upper holding nut for being tightened against the side of the supporting rod, for applying pressure to cant the rod in the openings, and the clamping screw being placed to avoid contacting the bolt.

13. The support and stop for a cymbal of claim 12, further comprising a felt ring on the bolt located between the upper and lower holding nuts, and the cymbal passing through the felt ring for being supported thereon.

14. The support and stop for a cymbal of claim 13, further comprising locking means above the felt ring and below the upper holding nut for holding the felt ring between the locking means and the lower holding nut.

* * * * *